United States Patent [19]

Suzuki

[11] Patent Number: 4,621,595

[45] Date of Patent: Nov. 11, 1986

[54] WATER-COOLED FOUR-CYCLE INTERNAL COMBUSTION ENGINE FOR OUTBOARD MOTORS

[75] Inventor: Tomonori Suzuki, Hamamatsu, Japan

[73] Assignee: Sanshin Kogyo Kabushiki Kaisha, Shizuoka, Japan

[21] Appl. No.: 643,647

[22] Filed: Aug. 23, 1984

[30] Foreign Application Priority Data

Aug. 25, 1983 [JP] Japan ..... 58-154174

[51] Int. Cl.[4] ..... F01P 3/12

[52] U.S. Cl. ..... 123/41.72; 123/41.79; 60/320; 440/900

[58] Field of Search ..... 123/41.72, 41.74, 41.79, 123/41.82 R, 195 P; 60/320, 321; 440/89, 900

[56] References Cited

U.S. PATENT DOCUMENTS

| | | | |
|---|---|---|---|
| 2,227,247 | 12/1940 | Conover | 123/41.74 |
| 2,322,961 | 6/1943 | Yingling | 123/41.78 |
| 3,692,006 | 9/1972 | Miller et al. | 440/89 |
| 3,921,398 | 11/1975 | Kashmerick | 440/89 |
| 4,343,270 | 8/1982 | Kawabe | 123/90.34 |
| 4,401,061 | 8/1983 | Matsushita et al. | 123/41.74 |
| 4,452,194 | 6/1984 | Watanabe | 123/195 P |

FOREIGN PATENT DOCUMENTS

| | | | |
|---|---|---|---|
| 981135 | 1/1976 | Canada | 440/89 |
| 58-44213 | 3/1983 | Japan . | |
| 2057380 | 4/1981 | United Kingdom . | |

*Primary Examiner*—William A. Cuchlinski, Jr.
*Attorney, Agent, or Firm*—Ernest A. Beutler

[57] ABSTRACT

A water-cooled, four-cycle internal combustion engine for an outboard motor having improved means for cooling the exhaust gases and specifically the exhaust gas passages of the cylinder head and cylinder block before discharge of the exhaust gases to the atmosphere.

12 Claims, 3 Drawing Figures

WATER-COOLED FOUR-CYCLE INTERNAL COMBUSTION ENGINE FOR OUTBOARD MOTORS

BACKGROUND OF THE INVENTION

This invention relates to a water-cooled, four-cycle internal combustion engine for outboard motors and more particularly to an improved arrangement for cooling the exhaust passages of such motors.

In connection with outboard motors, it has been the normal practice to route the exhaust gases from the engine downwardly through the drive shaft housing for discharge through an underwater exhaust. As a result, it is desirable to provide some effective degree of cooling of the exhaust gases before they are introduced into the drive shaft housing so as to reduce the likelihood of overheating. Furthermore, if the engine is of the four-cycle type, it has been the practice to route the exhaust gases through an internal passage formed in the cylinder head and cylinder block to their point of discharge. Hence, there is a fairly substantial degree of heating of the cylinder block itself by the exhaust gases and it is essential to provide adequate cooling so as to prevent distortion of the components and also so as to avoid failure of the cylinder head gasket. Although it has been proposed to provide a cooling jacket around the water passages, the cooling jackets of the type heretofore proposed may not always afforded the desired degree of cooling of the exhaust gases.

It is, therefore, a principal object of this invention to provide an improved water-cooled internal combustion engine for an outboard motor.

It is a further object of this invention to provide an improved cooling arrangement for cooling the exhaust gas passages of an outboard motor, particularly one operating on a four-stroke cycle.

SUMMARY OF THE INVENTION

A first feature of this invention is adapted to be embodied in a water-cooled internal combustion engine having a cylinder block, a cylinder head affixed to the cylinder block, a cooling jacket formed in the cylinder head and cylinder block and an exhaust passage that extends through the cylinder head and cylinder block for discharge of exhaust gases from the engine. The cooling jacket at least in part encircles the exhaust passage. In accordance with a first feature of the invention, an additional cooling jacket is provided in proximity at least in part to the exhaust passage.

Another feature of the invention is also adapted to be embodied in a water-cooled internal combustion engine having a cylinder block, a cylinder head affixed to the cylinder block, a cooling jacket formed in the cylinder head and cylinder block and an exhaust passage that extends through the cylinder head for discharge of exhaust gases from the engine. In accordance with this feature of the invention, a cooling jacket is formed in proximity to the cylinder head exhaust passage and which is supplied with coolant from the cooling jacket of the engine. In accordance with the invention, the water from the additional cooling jacket is discharged from the additional cooling jacket independently of the discharge of coolant from the main cooling jacket.

DETAILED DESCRIPTION OF THE PREFERRED EMBODIMENT

Figure 1:
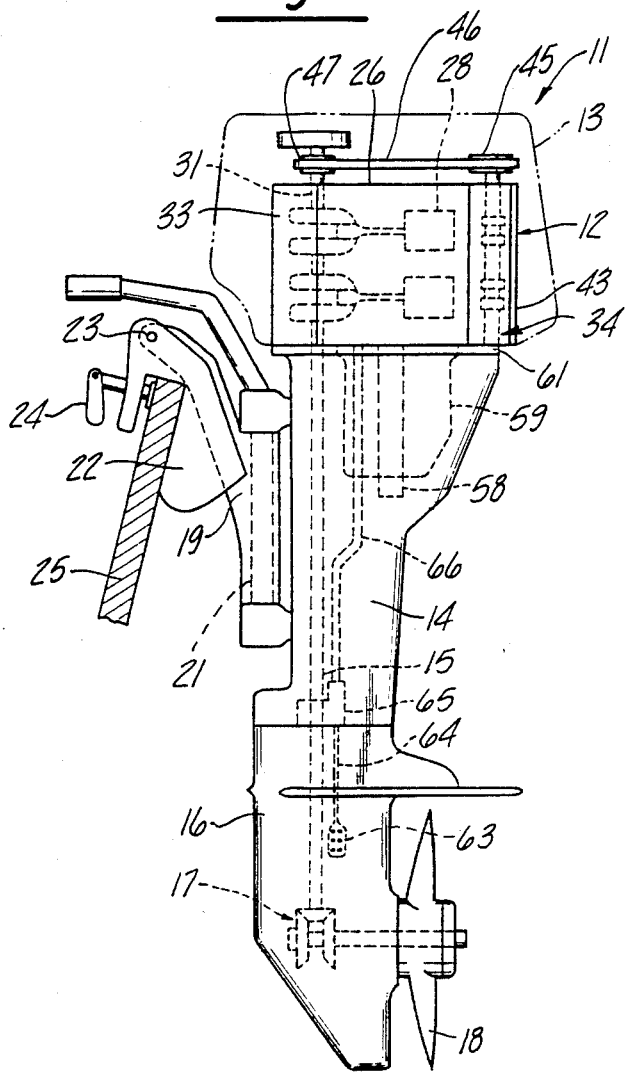
FIG. 1 is a side elevational view of an outboard motor constructed in accordance with an embodiment of the invention.

Referring now in detail to the drawings and initially to FIG. 1, an outboard motor constructed in accordance with an embodiment of the invention is identified generally by the reference numeral 11. The outboard motor 11 includes a power head consisting of an internal combustion engine, indicated generally by the reference numeral 12, and a surrounding protective cowling, which is shown in phantom in FIG. 1 and which is identified by the reference numeral 13. A drive shaft housing 14 depends from the power head and contains a drive shaft 15 that is driven by the engine output shaft in a manner to be described. A lower unit 16 is positioned at the lower end of the drive shaft housing 14 and contains a forward, neutral, reverse transmission 17 which is driven by the drive shaft 15 and, in turn, is adapted to drive a propeller 18 in a well known manner.

The drive shaft housing 14 is connected to a swivel bracket 19 by means including a steering shaft 21 for steering of the motor 11 about a vertically extending axis relative to the swivel bracket 19. The swivel bracket 19 is, in turn, affixed to a clamping bracket 22 by means of a tilt pin 23 so that the motor 11 may be tilted about a horizontally extending tilt axis defined by the pin 23. The clamping bracket 22 carries a clamp 24 so that the motor 11 may be detachably affixed to a transom 25 of an associated watercraft.

Referring now additionally to the remaining figures, the engine 12 is of the two cylinder in-line type and operates on the four-stroke principle. The engine 12 is comprised of a cylinder block 26 in which a pair of horizontally extending vertically spaced cylinder bores 27 are formed. Pistons 28 are supported for reciprocation within the cylinder bores and are connected by means of connecting rods 29 to a crankshaft 31. The crankshaft 31 is supported for rotation within a crank chamber 32 in a suitable manner between the cylinder block 26 and a crankcase 33 that is affixed to the cylinder block 26 in a known manner. The crankshaft 31 is drivingly coupled to the drive shaft 15 in a suitable manner.

A cylinder head, indicated generally by the reference numeral 34, is affixed to the cylinder block 26 with a cylinder head gasket 35 being interposed therebetween for providing a seal between the two surfaces. The cylinder head 34 is provided with a pair of recesses 36, each of which cooperates with the respective cylinder bore 27 and piston 28 to form the respective combustion chamber. An intake passage 37 is formed in the cylinder head 34 for each cylinder bore 28 and recess 36 and terminates ata valve seat 38 that is adapted to be engaged by the head of an intake valve 39. The intake valves 39 are operated by means of rocker arms 41 that are contained within a cam chamber 42 of the cylinder head 34. This cam chamber 42 is closed by a cam cover plate 43.

A camshaft 44 is journaled in the cylinder head 34 and has a driven sprocket or pulley 45 affixed to its exposed upper end. A toothed belt 46 engages the driven sprocket 45 and a driving sprocket 47 that is affixed to the exposed upper end of the crankshaft 31. The cam 44 has intake cam lobes 48 that engage the rocker arms 41 for operating the intake valves 39 in a known manner.

An intake manifold 50 is affixed to one side of the cylinder head 34 and is fed with a fuel/air mixture by one or more carburetors 49 for supplying the combustible mixture to the combustion chambers 36 in a known manner.

The opposite side of the cylinder head 34 is provided with a pair of exhaust passages 51, there being one such passage for each combustion chamber 36. The exhaust passages 51 terminate at the combustion chamber 36 in a valve seat 52 that cooperates with an exhaust valve 53 that is supported within the cylinder head 34 in a known manner. Each exhaust valve 53 is operated by means of an exhaust rocker arm 54 which is, in turn, operated by a respective exhaust cam lobe 55 of the camshaft 44.

The cylinder head exhaust passages 51 terminates in the face of the cylinder head 34 that mates with the cylinder block 26. The cylinder block 26 is, in turn, formed with mating exhaust passages 56 that lead into a vertically extending exhaust collector passage 57 of the cylinder block 26. The exhaust collector passage 57 communicates at its lower end with an exhaust pipe 58 that extends downwardly into the drive shaft housing 14 and which terminates in a suitable silencing arrangement (not shown). The exhaust gases are silenced in the drive shaft housing 14 and may be discharged through the lower unit 16 in any known manner as by a through the propeller exhaust gas discharge.

An oil pan or sump 59 is affixed to the underside of a spacer plate 61 which connects the power head to the drive shaft housing 14. Lubricant is circulated from the oil sump 59 to the portions of the engine to be lubricated and returned to the sump 59 in any suitable manner.

A pair of spark plugs 62 are supported in the cylinder head 34 and have their respective gaps disposed within the combustion chambers 36. The spark plugs 62 are fired by any suitable ignition system.

The motor 12 is of the water-cooled type and the coolant is derived from the body of water in which the motor 11 operates through a water intake 63 that is positioned within the lower unit 16 and from which a supply conduit 64 extends (FIG. 1). The supply conduit 64 terminates at a coolant pump 65 that is disposed at the lower end of the drive shaft housing 14 and which is driven by the drive shaft 15 in a known manner. Pressurized coolant is delivered from the pump 65 to the engine 12 through a supply line 66 that extends upwardly through the drive shaft housing and which terminates at an inlet of the engine.

The engine is provided with a cooling jacket, indicated generally by the reference numeral 67 that encircles a portion of the cylinder bore 27 and which extends at least in part adjacent to the cylinder block exhaust collector passage 57. A corresponding coolant jacket of the cylinder head 34 communicates with the cylinder block cooling jacket 67 and is identified by the reference numeral 68. The cylinder head cooling jacket portion 68 encircles primarily the combustion chambers 36 although a portion of it is disposed adjacent the cylinder head exhaust passages 51.

A cup shaped member 69 is affixed to an opening 71 that is formed in the side of the cylinder block 26 and which opens into the collector passage 57. The cup shaped member 69 is formed with a cavity 72 that is closed by a cover plate 73 which is affixed to the cup shaped member 69 and cylinder block 26 so as to affix these three components to each other.

Coolant is also delivered between the cavity 72 and the cylinder block cooling jacket 67 so as to provide cooling for the exhaust gases in the cylinder block 26 and specifically adjacent the exhaust collector passage 57.

Water from the cylinder block and cylinder head cooling jackets 67 and 68 is returned to the body of water in whch the motor 11 is operating through a suitable discharge (not shown).

Figure 2:
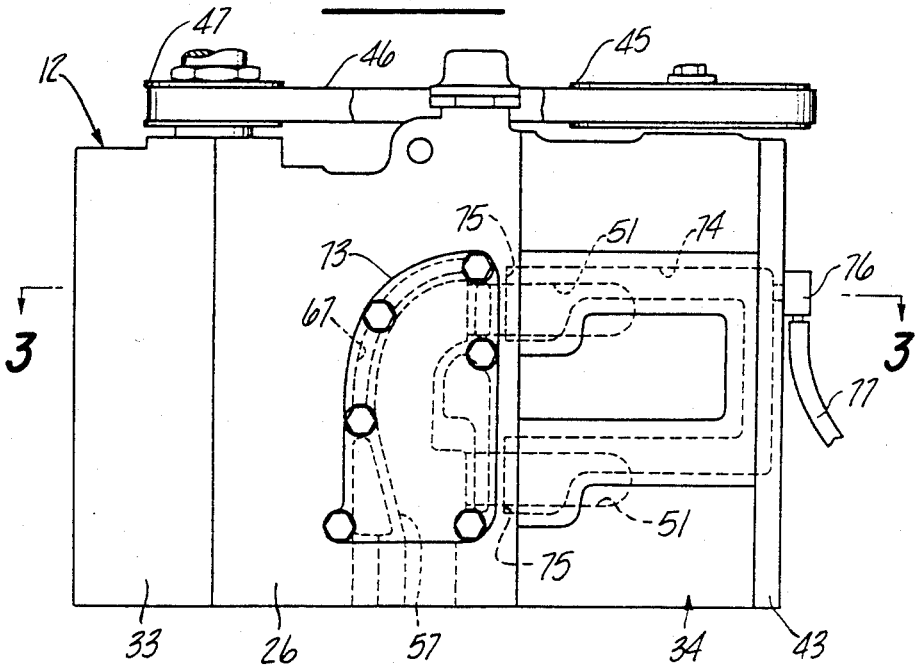
FIG. 2 is an enlarged side elevational view of the engine.
Figure 3:
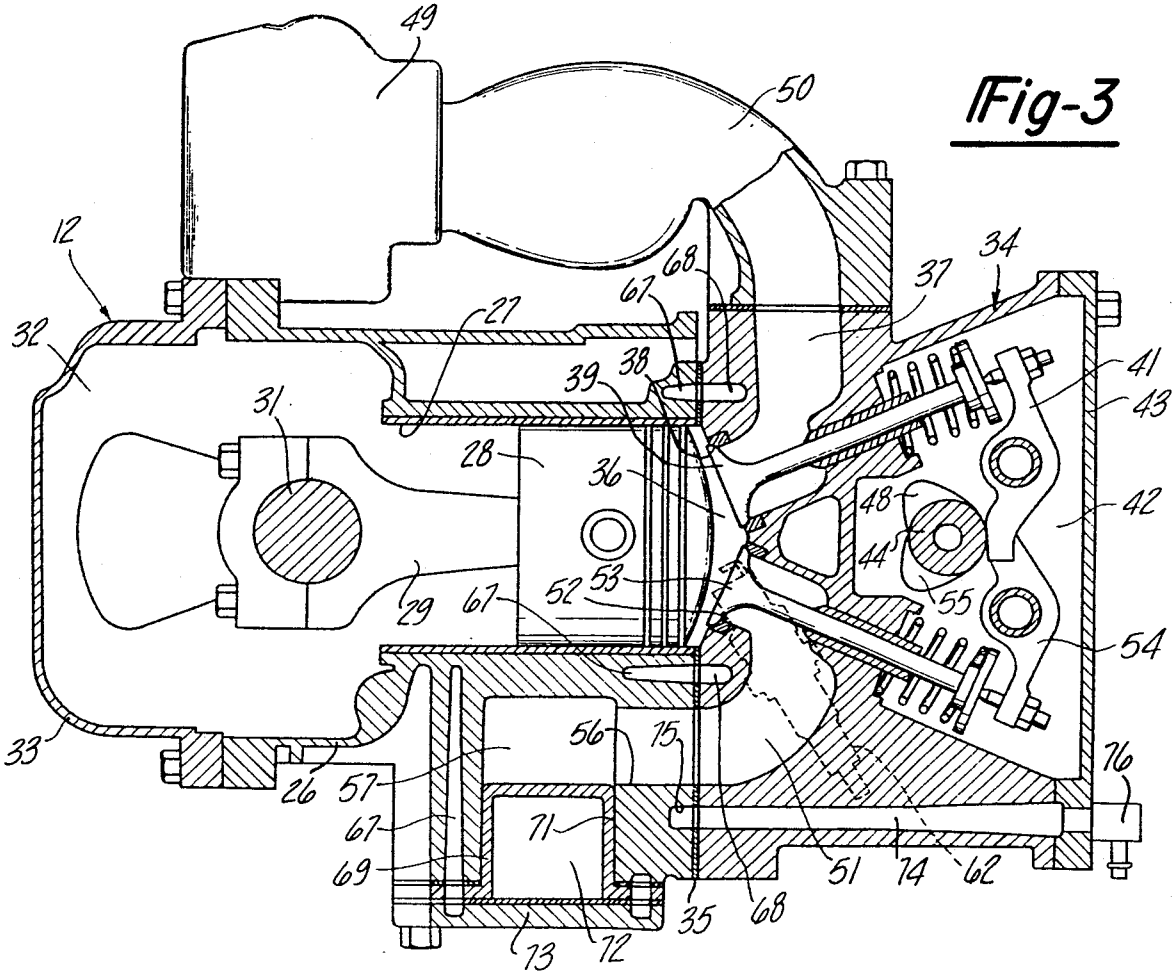
FIG. 3 is a cross-sectional view taken along the line 3—3 of FIG. 2.

In accordance with the invention, the cylinder head 34 is provided with a cooling jacket 74 that has a generally U shaped configuration in side elevation as may be readily seen in FIG. 2. The two legs of the U shape of the jacket 74 are disposed immediately adjacent the cylinder head exhaust passages 51 so as to provide initial cooling of the exhaust gases before they are delivered to the cylinder block 26. In this way, the gases will be cooled so as to reduce the likelihood of thermal shock and heat differential between the cylinder head and cylinder block that could damage the cylinder head gasket 35. In addition, the cylinder block 26 itself is provided with a pair of small cooling jackets 75 that communicate with the cylinder head cooling jacket 74 so as to provide further cooling in this area. Coolant is delivered to the cylinder block cooling jacket 75 and cylinder head cooling jacket 74 from a portion of either the cylinder block cooling jacket 67 or the cylinder head cooling jacket 68. However, the coolant which cools the cylinder head exhaust passages 51 is discharged directly back to the body of water independently of being returned to the main cooling system by a coolant discharge nipple 76 carried by the cam cover late 43 and discharge conduit 77.

It should be readily apparent from the foregoing description that a highly effective arrangement is provided for cooling the exhaust gases of the engine and particularly which includes a first cooling jacket of the engine which is in proximity to the exhaust passages, a second cooling jacket which is in proximity to the cylinder block exhaust collector passage and a still further cooling jacket which is formed in the cylinder head and cylinder block and which is disposed in proximity to the exhaust gas passages of the cylinder head and cylinder block.

Although an embodiment of the invention has been illustrated and described, it should be readily apparent that various changes and modifications may be made without departing from the spirit and scope of the invention, as defined by the appended claims.

I claim:

1. In a water-cooled internal combustion engine having a cylinder block, a cylinder head affixed to said cylinder block and forming a combustion chamber therewith, said cylinder head having a surface engaged with a corresponding surface of said cylinder block, a cooling jacket formed in said cylinder head and said cylinder block, an exhaust passage extending through said cylinder head from said combustion chamber through said cylinder head surface and said cylinder block for discharge of exhaust gases from said engine, said cooling jacket being positioned at least in part adjacent and in direct heat exchanging relation with said exhaust passage on one side thereof and adjacent said cylinder head surface, the improvement comprising an additional cooling jacket in proximity at least in part to the portion of said exhaust passage formed in said cylinder head and in direct heat exchanging relation therewith on the other side of said cylinder head surface.

2. In a water-cooled internal combustion engine as set forth in claim 1 wherein the additional cooling jacket is formed in both the cylinder block and cylinder head.

3. In a water-cooled internal combustion engine as set forth in claim 1 wherein the additional cooling jacket is formed within the castings of the cylinder block and cylinder head.

4. In a water-cooled internal combustion engine as set forth in claim 1 wherein the additional cooling jacket is supplied with coolant from the cooling jacket.

5. In a water-cooled internal combustion engine as set forth in claim 4 wherein the additional cooling jacket discharges coolant independently of the discharge of the coolant from the cooling jacket.

6. In a water-cooled internal combustion engine as set forth in claim 1 in combination with an outboard motor having a power head containing the engine, a drive shaft housing depending from the power head and a lower unit journaling a propeller driven by the engine output shaft, a coolant pump driven by the drive shaft and exhaust discharge means extending through the drive shaft housing and in communication with the engine exhaust passage for discharge of exhaust gases.

7. In a water-cooled internal combustion engine as set forth in claim 6 wherein the additional cooling jacket is formed in both the cylinder block and cylinder head.

8. In a water-cooled internal combustion engine as set forth in claim 6 wherein the additional cooling jacket is formed within the castings of the cylinder block and cylinder head.

9. In a water-cooled internal combustion engine as set forth in claim 6 wherein the additional cooling jacket is supplied with coolant from the cooling jacket.

10. In a water-cooled internal combustion engine as set forth in claim 9 wherein the additional cooling jacket discharges coolant back to the body of water in which the engine is operating independently of the discharge of the coolant from the cooling jacket.

11. In a water-cooled internal combustion engine as set forth in claim 1, including means for delivering coolant from said cooling jacket to said additional cooling jacket and means for discharging coolant from said additional cooling jacket independently of said cooling jacket.

12. In a water-coolant internal combustion engine as set forth in claim 11 in combination with an outboard motor having a power head containing the engine, a drive shaft housing depending from the power head and a lower unit journaling a propeller driven by the engine output shaft, a coolant pump driven by the drive shaft and exhaust discharge means extending through the drive shaft housing and in communication with the engine exhaust passage for discharge of exhaust gases, the additional cooling jacket being operative to discharge water back into the body of water in which said motor operates independently of said cooling jacket.

* * * * *

US004621595B1

REEXAMINATION CERTIFICATE (2823rd)

United States Patent [19]

Suzuki

[11] B1 4,621,595

[45] Certificate Issued Mar. 26, 1996

[54] WATER-COOLED FOUR-CYCLE INTERNAL COMBUSTION ENGINE FOR OUTBOARD MOTORS

[75] Inventor: Tomonori Suzuki, Hamamatsu, Japan

[73] Assignee: Sanshin Kogyo Kabushiki Kaisha, Hamamatsu, Japan

Reexamination Request:
No. 90/002,383, Jun. 3, 1991

Reexamination Certificate for:

| | |
|---|---|
| Patent No.: | **4,621,595** |
| Issued: | **Nov. 11, 1986** |
| Appl. No.: | **643,647** |
| Filed: | **Aug. 23, 1984** |

[30] Foreign Application Priority Data

Aug. 25, 1983 [JP] Japan ..... 58-154174

[51] Int. Cl.[6] ..... F01P 3/12

[52] U.S. Cl. ..... 123/41.72; 123/41.79; 60/320; 440/900

[58] Field of Search ..... 123/41.72, 41.74, 123/41.79, 41.82 R, 195 P; 60/320, 321; 440/89, 900

[56] References Cited

U.S. PATENT DOCUMENTS 4,452,194 6/1984 Watanabe et al. ..... 123/195

FOREIGN PATENT DOCUMENTS 51-56441 5/1975 Japan .
2030218 4/1980 United Kingdom .

OTHER PUBLICATIONS

Johnson Service Manual (1977) pp. 5-1 through 5-22 plus 9.9/15 HP Water Flow Diagram.

*Primary Examiner*—Noah Kamen

[57] ABSTRACT

A water-cooled, four-cycle internal combustion engine for an outboard motor having improved means for cooling the exhaust gases and specifically the exhaust gas passages of the cylinder head and cylinder block before discharge of the exhaust gases to the atmosphere.

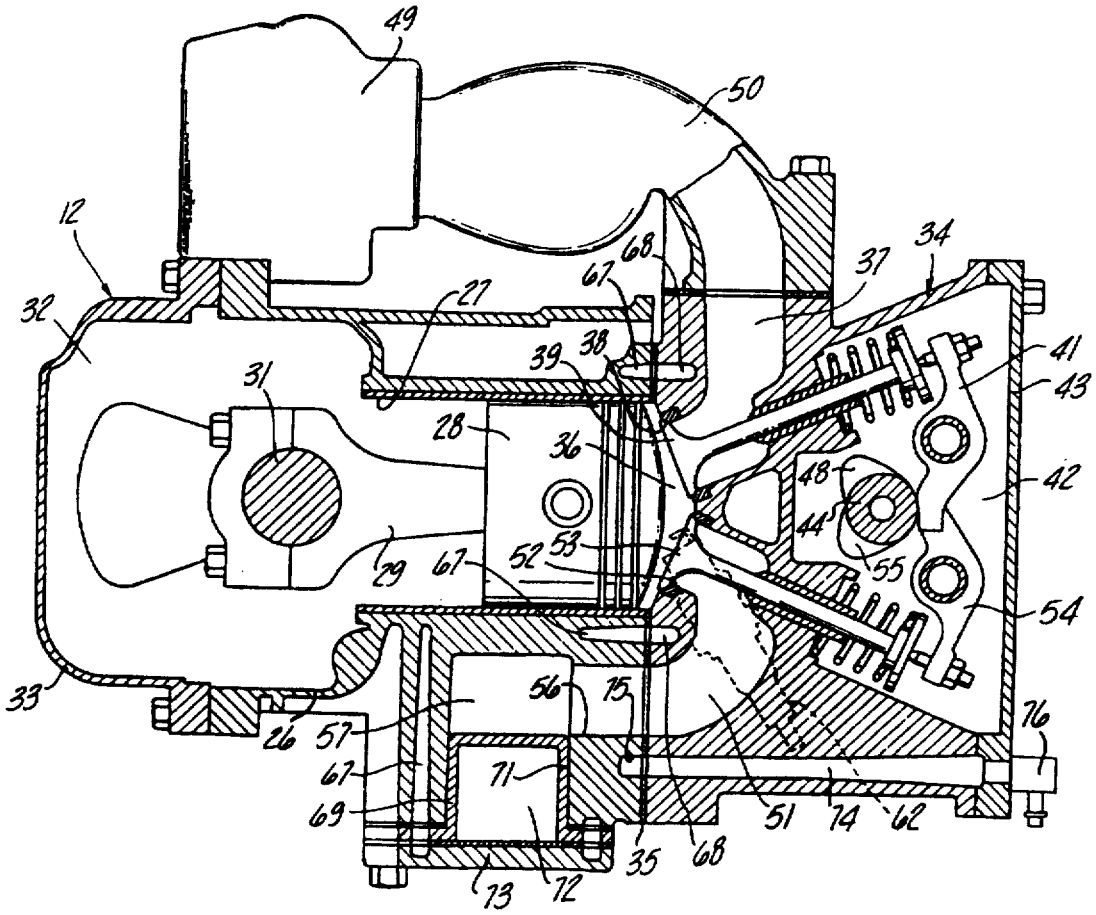

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–4 and 6–9 are cancelled.

Claims 5, 10 and 11 are determined to be patentable as amended.

Claim 12, dependent on an amended claim, is determined to be patentable.

5. In a water cooled internal combustion engine [as set forth in claim 4 wherein] *having a cylinder block, a cylinder head affixed to said cylinder block and forming a combustion chamber therewith, said cylinder head having a surface engaged with a corresponding surface of said cylinder block, a cooling jacket formed in said cylinder head and said cylinder block, an exhaust passage formed integrally in said cylinder head and said cylinder block and extending through said cylinder head from said combustion chamber through said cylinder head surface and said cylinder block for discharge of exhaust gases from said engine, said cooling jacket being positioned at least in part adjacent and in direct heat exchanging relation with portions of said exhaust passage extending through both said cylinder head and said cylinder block on one side of said exhaust passage and extending through said cylinder head surface, the improvement comprising an additional cooling jacket in proximity at least in part to the port of said exhaust passage formed in said cylinder head and in direct heat exchanging relation therewith on the other said of said exhaust passage and supplied with coolant from the cooling jacket,* wherein the additional cooling jacket discharges coolant independently of the discharge of the coolant from the cooling jacket.

10. In a water cooled internal combustion engine [as set forth in claim 9 wherein] *in combination with an outboard motor having a power head containing the engine, a drive shaft housing depending from the power head and a lower unit journaling a propeller driven by the engine output shaft, a coolant pump driven by the drive shaft and exhaust*

*discharge means extending through the drive shaft housing and in communication with the engine exhaust passage for discharge of exhaust gases, said engine having a cylinder block, a cylinder head affixed to said cylinder block and forming a combustion chamber therewith, said cylinder head having a surface engaged with a corresponding surface of said cylinder block, a cooling jacket formed in said cylinder head and said cylinder block, an exhaust passage formed integrally in said cylinder head and said cylinder block and extending through said cylinder head from said combustion chamber through said cylinder head surface and said cylinder block for discharge of exhaust gases from said engine, said cooling jacket being positioned at least in part adjacent and in direct heat exchanging relation with portions of said exhaust passage extending through both said cylinder head and said cylinder block on one side of said exhaust passage and extending through said cylinder head surface, the improvement comprising an additional cooling jacket in proximity at least in part to the port of said exhaust passage formed in said cylinder head and in direct heat exchanging relation therewith on the other said of said exhaust passage and supplied with coolant from the cooling jacket,* wherein the additional cooling jacket discharges coolant back to the body of water in which the engine is operating independently of the discharge of the coolant from the cooling jacket.

11. In a water cooling internal combustion engine [as set forth in claim 1,] *having a cylinder block, a cylinder head affixed to said cylinder block and forming a combustion chamber therewith, said cylinder head having a surface engaged with a corresponding surface of said cylinder block, a cooling jacket formed in said cylinder head and said cylinder block, an exhaust passage formed integrally in said cylinder head and said cylinder block and extending through said cylinder head from said combustion chamber through said cylinder head surface and said cylinder block for discharge of exhaust gases from said engine, said cooling jacket being positioned at least in part adjacent and in direct heat exchanging relation with portions of said exhaust passage extending through both said cylinder head and said cylinder block on one side of said exchaust passage and extending through said cylinder head surface, the improvement comprising an additional cooling jacket in proximity at least in part to the port of said exhaust passage formed in said cylinder head and in direct heat exchanging relation therewith on the other said of said exhaust passage, and* including means for delivering coolant from said cooling jacket to said additional cooling jacket and means for discharging coolant from said additional cooling jacket independently of said cooling jacket.

* * * * *